US010415194B2

(12) United States Patent
Neumann

(10) Patent No.: US 10,415,194 B2
(45) Date of Patent: Sep. 17, 2019

(54) ROAD PAVER OR FEEDER WITH APPROACH GUIDANCE AID, AND APPROACH GUIDANCE AID

(71) Applicant: BOMAG GMBH, Boppard (DE)

(72) Inventor: Tobias Neumann, Remagen (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 15/606,330

(22) Filed: May 26, 2017

(65) Prior Publication Data

US 2017/0356140 A1 Dec. 14, 2017

(30) Foreign Application Priority Data

May 27, 2016 (DE) ..... 10 2016 006 495

(51) Int. Cl.
*E01C 19/48* (2006.01)

(52) U.S. Cl.
CPC ..... *E01C 19/48* (2013.01); *E01C 2301/02* (2013.01); *E01C 2301/08* (2013.01)

(58) Field of Classification Search
CPC ..... E01C 19/29; E01C 19/405; E01C 19/48; E01C 19/40; E01C 23/14; E01C 2019/207; E01C 2301/02; E01C 2301/08
See application file for complete search history.

(56) References Cited

U.S. PATENT DOCUMENTS 3,000,277 A * 9/1961 Crane ..... E01C 19/008 404/118
3,275,342 A * 9/1966 Layton ..... B60D 1/167 280/460.1
4,955,754 A * 9/1990 Smith ..... B60D 3/00 293/134
5,004,394 A * 4/1991 Goodwin ..... B60R 19/00 293/134
5,356,238 A * 10/1994 Musil ..... E01C 19/008 404/101
5,529,434 A * 6/1996 Swisher, Jr. ..... E01C 19/48 404/108
6,193,437 B1 * 2/2001 Heims ..... E01C 19/48 404/101
9,145,649 B2 * 9/2015 Buschmann ..... E01C 19/48
9,481,966 B2 * 11/2016 Frelich ..... E01C 19/182
9,580,875 B1 * 2/2017 D'Ascanio ..... E01C 19/48
9,656,525 B2 * 5/2017 Gotterbarm ..... B60D 3/00
9,863,102 B2 * 1/2018 Fickeisen ..... E01C 19/48
(Continued)

FOREIGN PATENT DOCUMENTS

DE 10200361 7/2003
DE 102013216374 2/2015

*Primary Examiner* — Abigail A Risic

(74) *Attorney, Agent, or Firm* — Grossman, Tucker, Perreault & Pfleger, PLLC

(57) ABSTRACT

A road paver or a feeder with a machine frame, a travel carriage driven by a drive unit, and a material hopper arranged in the front in the operating direction on the road paver or the feeder, the material hopper comprising a hopper bottom and side walls extending in the operating direction, at least one approach guidance aid protruding beyond the hopper bottom and the side walls in the operating direction being arranged on the road paver or the feeder in the edge region of the material hopper transversely to the operating direction. The approach guidance aid may also be provided for use with a road paver or feeder.

20 Claims, 4 Drawing Sheets

(56) References Cited

U.S. PATENT DOCUMENTS

| | | | | |
|---|---|---|---|---|
| 2012/0299270 | A1* | 11/2012 | Buschmann | E01C 19/48 280/481 |
| 2013/0183092 | A1* | 7/2013 | Van Beek | E01C 19/48 404/72 |
| 2013/0322965 | A1* | 12/2013 | Frelich | E01C 19/48 404/108 |
| 2014/0037375 | A1* | 2/2014 | Frelich | E01C 19/48 404/72 |
| 2015/0132058 | A1* | 5/2015 | Anderson | E01C 19/48 404/84.05 |
| 2016/0040368 | A1* | 2/2016 | Frelich | E01C 19/48 404/110 |

* cited by examiner

Fig. 6
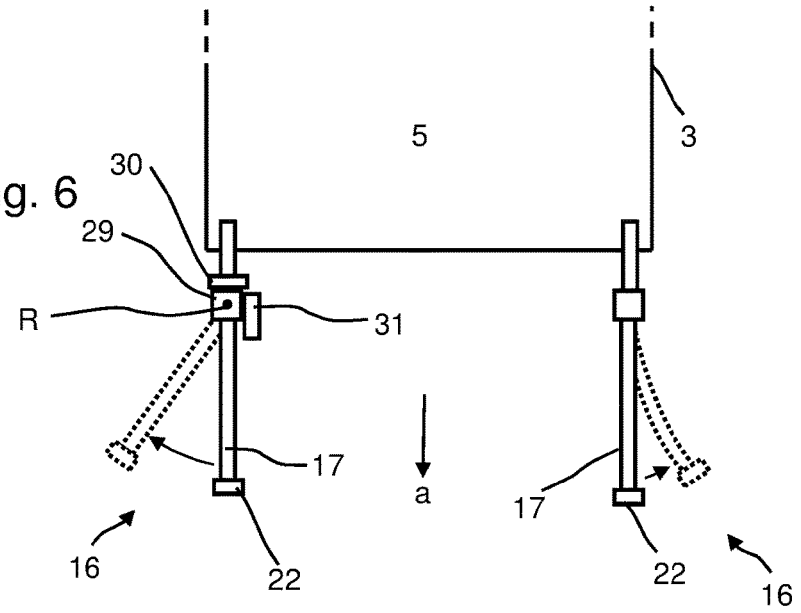
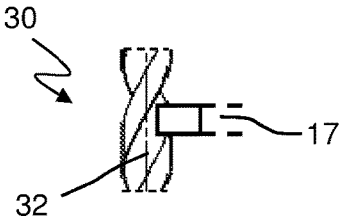
Fig. 7A
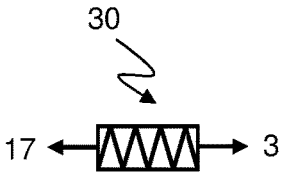
Fig. 7B

ROAD PAVER OR FEEDER WITH APPROACH GUIDANCE AID, AND APPROACH GUIDANCE AID

FIELD

The invention relates to a road paver or feeder. The invention further relates to an approach guidance aid for such a road paver or feeder.

BACKGROUND

Generic road pavers or feeders, hereinafter also collectively referred to as road construction machines, are used for laying base layers, for example, concrete or asphalt layers, for example in road construction (road paver) or for intermediate storing and transferring paving material during the paving process (feeder). The respective base layer is paved by a road paver, which is supplied with construction material for the base layer directly by a transport vehicle, for example, a truck, or via a feeder during the paving process. When using a feeder, it is supplied with paving material by a transport vehicle, and transfers the paving material via a suitable conveyor device to the road paver, which prepares the base layer. Both the paver and the feeder have a machine frame and a travel unit, for example, crawler tracks or wheels, driven by a drive unit, in most cases a diesel engine. In the operating direction of the road construction machine, it has a material hopper in the front. The operating direction refers to that direction in which the road construction machine moves during normal operation, i.e., during paving operation. The material hopper is a loading space for paving material, the size of which can be increased and/or decreased by moving and/or tilting the hopper walls. The material hopper includes a hopper floor and side walls extending in the operation direction and normally also a rear wall. The paving material is conveyed backwards or towards the rear from the material hopper via a conveyor device, for example, a scraper belt, through the road construction machine, where, in the case of a feeder, a conveyor device is arranged, which transfers the paving material from the feeder to the road paver. In the case of a road paver, a transverse conveyor, for example, a screw conveyor, and a paving screed are located on the rear, through which the paving material is spread across the entire paving width, smoothed, and pre-compacted. A smooth, pre-compacted base layer is left behind the road paver, which can be further compacted, for example, by rollers, in order to achieve a finished road.

The transfer of the paving material from the transport vehicle to the generic road construction machine, be it a feeder or a road paver, occurs respectively in the same way. A truck loaded with the paving material drives backwards to just in front of the road construction machine driving in the operating direction and then stops. A controlled collision between both vehicles is then effected. For this, a collision device such as buffer rollers may be present, for example on the end of the road construction machine located in the front in the operating direction, which come into contact with the rear of the transport vehicle by slowly moving the road construction machine forward. The road construction machine then pushes the transport vehicle in front of it using the buffer rollers, while the paving process of the road paver is continued. The transport vehicle can then transfer the paving material, for example, by tilting the loading area backwards into the material hopper of the road construction machine arranged in the front in the operating direction. As soon as the transfer is completed, the loading area can be lowered again and the transport vehicle drives away in the forward direction.

The driver of the transport vehicle needs to approach the hopper edge of the road construction machine located in the front in the operating direction with the rear end of the transport vehicle in a targeted manner. The region of the hopper edge of the road construction machine located in the front in the operating direction, to which the rear end of the transport vehicle needs to be guided to, is also called approach zone. The approach zone is mostly predetermined by the extension of the collision device, for example the buffer rollers, transverse to the operating direction. Typically, the approach zone is arranged in the center of the road paver or feeder and spaced from the side walls of the material hopper, so that these are arranged outside the approach zone. When positioning the transport vehicle in front of the road construction machine, which is not exactly centered or which is located outside the approach zone, respectively, it happens that the rear end of the transport vehicle comes into contact or collides with one of the foldable side walls of the material hopper located outside transversely to the operating direction. The side wall of the hopper can bend due to heavy and/or constant collisions. In the long run, this can lead to a loss of functioning of the foldable side walls of the material hopper of the road construction machine in the worst case. Due to the plurality of loading processes, which are necessary in the working mode of the road construction machine, such damages to the road pavers of feeders known from the prior art can often not be prevented in the long run, even with careful drivers of the transport vehicles.

DE 10 2013 216 374 A1 discloses a road paver, which provides folding elements on the hopper adjustable toward the loading vehicle. These folding elements can be adjusted from a projecting position in the direction of the interior of the mixing material container. The folding elements of DE 10 2013 216 374 A1 serve for preventing the mixing material from falling out of the mixing material container in the paving process. It is provided that the folding elements are swung open toward the front when filling the hopper, in order to enlarge the front opening of the hopper during the loading process.

SUMMARY

It is the object of the present invention to provide a possibility of how to better prevent such damages of the material hopper while transferring the paving material from a transport vehicle to a road paver or a feeder, or how the approach and correct positioning of the transport vehicle relative to the hopper can be facilitated in particular for the driver of the transport vehicle.

The object can be achieved by a road paver or feeder or an approach guidance aid, respectively, according to the independent claims. Preferred embodiments are indicated in the dependent claims.

Specifically, the object is achieved in the aforementioned road paver or feeder in that at least one approach guidance aid projecting over the hopper bottom and the side walls in the operating direction in a guidance position opposite the paving direction is arranged on the road paver or feeder in the edge region of the material hopper located outside transverse to the operating direction, wherein the approach guidance aid is adjustable at least partially from the guidance position to an avoiding position in a non-destructive manner. The edge region of the material hopper displayed transversely to the operating direction extends e.g. over a third, in particular a quarter, and preferably over a fifth, of the front side of the material hopper. These indications can refer to a material hopper extended transversely to the operating direction as well as to one retracted transversely to the operating direction and preferably relate to a material hopper extended transversely to the operating direction as the material hopper typically is in the extended position during the transfer process of paving material from a transport vehicle into the material hopper. It is important that the approach guidance aid is arranged transversely to the operating direction of the road paver or feeder and next to the approach zone of the transport vehicle. The approach guidance aid is thus located on the road paver or feeder directly or at a little distance to the approach zone for the transport vehicle offset outward and transverse to the operating direction. It is arranged on the end of the road paver or feeder located in the front in the operating direction in such a way that it projects over the road paver or feeder to the front in the operating direction. This initial position of the approach guidance aid is referred to as a guidance position. In the initial position, the approach guidance aid preferably maximally projects from the remaining paver in the paving direction. Each movement of the approach guidance aid or of parts thereof thus results in that the approach guidance aid or at least parts thereof are adjusted at least partially relative to the paving direction. Thus, the approach guidance aid extends further to the front in the operating direction than any other part of the road paver or feeder. In particular, the approach guidance aid extends further to the front in the working or paving direction than the side walls of the material hopper, which partially per se may also project over further parts of the road paver or feeder. According to the invention, however, the approach guidance aid is the part of the road paver or feeder which extends farthest to the front in the operating direction and in particular also projects over the side walls in the operating direction. Here, the approach guidance aid has no material guidance function and/or retaining function. The approach guidance aid rather serves explicitly and in particular for facilitating the orientation of a driver of a transport vehicle for paving material when approaching the road paver or feeder. In this way, the approach guidance aid offers an optical support to the driver, by means of which he or she can orient himself or herself when approaching the material hopper with the rear end of the transport vehicle. Furthermore, the approach guidance aid also serves as a warning means for the driver of the transport vehicle when a collision between the rear end of the transport vehicle and the approach guidance aid is about to take place. If this should happen, the driver knows in good time that he or she missed the approach zone and needs to correct the position of the vehicle. At the same time, the approach guidance aid, being upstream of the end of the road paver or feeder located in the front in the operating direction, ensures that there will always be a collision between the approach guidance aid and the rear end of the transport vehicle in the first place before the rear of the transport vehicle can come into contact or collide with the side walls of the material hopper. In this way, damage of the side walls of the material hopper is efficiently prevented. According to the invention, the approach guidance aid is thus placed in a potential collision region in a targeted manner, so that it often happens in practice that collisions between at least parts of the approach guidance aid and a transport vehicle occur. According to the invention, this factor is faced in a reasonable manner in that the approach guidance aid is configured in such a way that it is adjustable from the guidance position to an avoiding position or an avoidance region to the outside in a non-destructive manner. From the guidance position, the approach guidance aid moves at least partially away from the interior of the hopper. When viewed in the paving direction, the approach guidance aid thus turns out at least partially to a side in case of a collision, specifically to the side facing away from the hopper, or is adjusted to an avoiding position by the colliding part without being damaged. In this way, it is possible that the approach guidance aid is not damaged or even destroyed when colliding with a transport vehicle, but is pushed to the outside away from the collision region. This is advantageous in that the functional integrity of the approach guidance aid is maintained thereby even in the case of multiple collisions actually happening, and replacement of at least parts of the approach guidance aid is not required. With the approach guidance aid additionally turning out at least partially to the outside, it is also reliably prevented that the filling opening of the hopper is made smaller unintentionally.

According to the invention, it is thus provided to provide, with the approach guidance aid, a device on the road paver or feeder with which the driver of the transport vehicle obtains an improved orientation on the road paver of feeder on the one hand, and a collision with the rear end of the transport vehicle takes place prior to a collision with one of the side walls of the material hopper on the other hand. This is acceptable as the approach guidance aid according to the invention in general can be repaired significantly more cost efficient and simpler than a side wall of the hopper and furthermore is per se configured in such a way that it is adjustable from the guidance position to an avoiding position at least partially to the outside without damages and thus automatically attenuates destructive consequences. It is thus provided according to the invention that at least in the first place no damage of the approach guidance aid comes along with a collision of the approach guidance aid with the rear end of the transport vehicle. This can for example be achieved in that the approach guidance aid is configured elastically so that when colliding with the rear end of the transport vehicle it is merely deformed but returns to its original shape after the collision. Basically, the approach guidance aid can be designed in different shapes. It is for example possible to configure the approach guidance aid as a stick or a rod and at least partially of an elastic material, for example a rubber material, oriented to the front in the operating direction. To offer an optimum optical positioning aid to the driver of the transport vehicle, it is advantageous, however, if the approach guidance aid has a planar configuration, for example as a plate. Therefore, it is preferred overall that the approach guidance aid comprises a, in particular elastic, guidance plate projecting beyond the side walls in the operating direction. The guidance plate is a planar component, the large dimension of which results in good visibility even in difficult working conditions as can prevail be on roadbuilding sites, in particular in different lighting and weather conditions. Due to the configuration as elastic guidance plate, i.e. the guidance plate per se consists of an elastic material, destruction-free collisions of the approach guidance aid with the rear end of the transport vehicle are enabled whereby a damage of the road paver of feeder can reliably be prevented when transferring paving material. Additionally, or as an alternative it is also possible to provide an elastic link of the approach guidance aid to the remaining road paver/feeder, such as for example a joint connection, an elastic bearing, for example rubber bearing etc. Then in particular, also rigid materials can be used for forming of the approach guidance aid, in particular the guidance plate. Basically, non-elastic pivot bearings can also be used for the connection. If the guidance plate as a whole is pivotable, it is preferably supported pivotably about a vertical axis via a pivot joint.

It is preferred if the guidance plate of the approach guidance aid projects horizontally to the front in the operating direction of the road paver or feeder to the maximum extent in the guidance position, i.e. the position it has in the collision-free normal case. That means that any movement of the guidance plate from the guidance position results in a shortening of the horizontal distance of the front face of the guidance plate facing away from the road paver or feeder. Regarding the width of the road paver or feeder, the guidance plate takes the smallest space on the one hand, and projects in the paving direction to the maximum extent on the other hand. Preferably, the guidance plate in the guidance position thus assumes a position extending perpendicular with respect to the width of the road paver or feeder.

According to the invention, the approach guidance aid and in particular the guidance plate have a certain movement spectrum. To ensure that the approach guidance aid and in particular the guidance plate generally takes the guidance position and to increase the operational comfort, preferably a return device or restoring device is present, which automatically returns the approach guidance aid and in particular the guidance plate from a avoiding position to the guidance position. Thus, this means that the approach guidance aid and in particular the guidance plate returns automatically and without manual influence from the respective avoiding position to the guidance position after a collision, for example after removing a formerly collided transport vehicle. Hence, an operator of the road finisher or the feeder, for example, after a turn-out of the approach guidance aid, does not separately need to ensure that the approach guidance aid, in particular the guidance plate, is returned to the guidance position prior to a continuation of the paving procedure.

In the specific configuration of the return device, various specific configurations are possible, as long as the automatic returning is ensured. For example, it is preferred if the return device is configured in such a way that its return effect is due to an effect of an elastic material of the approach guidance aid, in particular the guidance plate. To that end, an elastic bearing or the like can be used, for example. Alternatively, and particularly preferably, the approach guidance aid comprises a guidance plate per se consisting of an elastic material, however. If the guidance plate is displaced from its guidance position to a avoiding position, the guidance plate is bent out of the guidance position. The returning effect then is due to the elasticity of the guidance plate material per se. Additionally or as an alternative, a spring load can also be provided, in particular using a tension or pressure spring acting in the direction of the guidance position. Further additionally or as an alternative, a return mechanism can be used that is driven by gravity. To that end, for example the guidance plate can be guided pivotably in a spiral groove having a spiral axis extending vertically, wherein the bearing is configured in such a way that the guidance plate in its guidance position takes on its low point in the spiral groove. If the guidance plate is pushed out of the guidance position here, this results in the plate being adjusted upward in the vertical direction at the same time due to the spiral groove guidance. The potential energy obtained thereby can also be used for returning purposes in the present case.

It can further be provided for the return device to comprise a releasable latch device, by means of which the guidance plate is held in the guidance position up to a predetermined load limit. This latch device ensures that adjusting of the approach guidance aid and in particular of the guidance plate is effected only when exceeding a predetermined load limit. This can be reasonable, for example, when an unintentional adjustment of the approach guidance aid and in particular of the guidance plate is to be prevented in strong wind conditions. Such a device for position stabilization can for example be a cam or a similar obstacle which is based upon a form-fit, to be driven over by the approach guidance aid and in particular the guidance plate from the guidance position and/or a friction brake.

In particular, it is provided for the guidance aid according to the invention that it is specifically not adjustable toward the interior of the hopper from the guidance position in order to not constitute an element potentially making the hopper opening smaller. Thus, it is preferred if an inward pivot limit, for example an inward pivot stop is present which locks the approach guidance aid and in particular the guidance plate in the guidance position toward the hopper. As a result, it is achieved in a simple manner that the approach guidance aid and in particular the guidance plate does not pivot from the avoidance region beyond the guidance position.

A good visibility of the approach guidance aid generally can already be seen by an approaching transport vehicle due to the arrangement of the approach guidance aid projecting from the hopper. However, the visibility can be further improved in that at least a part of the approach guidance aid extends upward in the vertical direction, and in particular projects upward from the hopper bottom of the material hopper. Vertically upward here refers to the direction away from the ground on which the road paver or feeder stands. Vertically downward denotes the direction in the direction toward the ground. Therefore, it is preferred that the approach guidance aid is oriented parallel to the operating direction and vertical, in particular in the configuration of the approach guidance aid having a guidance plate. The approach guidance aid, due to being arranged in parallel to the operating direction, extends as far as possible beyond the further parts of the road paver of feeder to the front in the operating direction. The approach guidance aid, in particular the guidance plate of the approach guidance aid, due to its vertical arrangement, also extends in the vertical direction and thus projects in particular beyond the hopper bottom of the material hopper. Particularly preferably, the approach guidance aid or in particular the guidance plate is located in a vertical plane oriented to the operating direction. Overall, the approach guidance aid is thus particularly easy discernable for the driver of a transport vehicle.

According to the invention, the approach guidance aid is arranged in an edge region of the material hopper located outside and transverse to the operating direction. For example, the approach guidance aid can be fastened directly to an outer edge of the machine or extend this edge to the front in the operating direction beyond the material hopper. In such an embodiment, the greatest possible area on the side of the road paver or feeder located in the front in the operating direction is at the driver's disposal for approaching. The approach zone for the transport vehicle is thus particularly large and it is particularly easy to approach the transport vehicle within this zone to the material hopper or the road paver or feeder. However, it is preferred if only one region of the front side of the road paver or feeder offset toward the interior transverse to the operating direction is used as the approach zone. Therefore, it is preferred if the approach guidance aid is arranged offset relative to an outer edge of the machine, and in particular relative to the side wall of the material hopper toward the interior transverse to the operating direction. In other words, the approach guidance aid is preferably arranged between the inner walls of the hopper side walls opposite one another. In this way, the driver of the transport vehicle is guided rather to the center of the road paver or feeder by the approach guidance aid. In this way, it is prevented that paving material can laterally fall off the material hopper and fall down to the ground. Furthermore, it is achieved by the offset of the approach guidance aid toward the center of the machine, that the approach guidance aid is provided between the approach zone for the transport vehicle and the side wall of the material hopper, which are arranged substantially on the outer edge of the machine. In this way, a damage of the side wall is prevented particularly efficiently as a transport vehicle that intends to approach the approach zone always collides with the approach guidance aid in the first place before it reaches the side wall and can collide therewith, as the side wall is located on the side of the approach guidance aid opposite the approach zone.

As already mentioned above, usually a collision device is present in generic road pavers or feeders, in particular at least one buffer roller, with which the road paver or feeder can push a transport vehicle in front of itself in the operating direction. The zone in which the transport vehicle can be pushed in front of the road paver or feeder by the road paver or feeder, is the approach zone. In this region, the transport vehicle is to be able to approach up to the road paver or feeder. Thus, it is preferred that the approach guidance aid is arranged offset to the collision device toward the outside transverse to the operating direction. In other words, the approach guidance aid is arranged on the road paver or feeder outside the approach zone for the transport vehicle. Overall, the approach guidance aid is thus preferably located transverse to the operating direction between the collision device and one side wall of the material hopper. In this way, the approach guidance aid can be used by the driver of the transport vehicle for precisely approaching the road paver or feeder or the approach zone while the side of the material hopper located behind the approach guidance aid when seen from the approach zone is reliably protected from colliding with the rear of the transport vehicle.

To increase stability of the approach guidance aid, in particular in an elastic approach guidance aid, it is advantageous if a support is provided, for example a support plate which rests against the approach guidance aid in a planar fashion. An embodiment is preferred in which the approach guidance aid comprises a support plate which is arranged parallel to the approach guidance aid, in particular to the guidance plate, and rests thereon and is fastened thereto. Here, the support plate is configured as a planar component, which is connected to the approach guidance aid or the guidance plate with one of its planar sides, in particular with the entire surface thereof. The support plate consists in particular of a bend-proof or at least less elastic material than the approach guidance aid or the guidance plate, whereby the support plate supports the approach guidance aid and thus at the same time ensures the desired alignment of the approach guidance aid in particular in the guidance position and increases durability thereof.

Generally, the approach guidance aid is advantageously fastened to the road paver or feeder by means of a fastening device. It is particularly preferred that the approach guidance aid comprises a fastening device via which the approach guidance aid is fastened to the machine frame and/or to the material hopper, in particular to a side wall of the material hopper. The difference between a fastening to the material hopper in contrast to a fastening to the machine frame is that the material hopper in road pavers or feeders is usually configured to be adjustable in such a way that for example the hopper bottom comprises two parts which are moveable relative to one another together with the respective side walls transversely to the operating direction of the road paver or feeder, in particular pivotably and/or displaceably, so that the size or the loading volume of the material hopper can be increased by a movement of the side walls away from one another, or decreased in a movement towards one another. If the approach guidance aid is fastened to the material hopper, the approach guidance aid follows this movement of the material hopper or the hopper bottom and the side walls oriented at least partially transverse to the operating direction. If the approach guidance aid is in contrast, for example vertically below the material hopper, fastened to the machine frame, the approach guidance aid does not follow the adjustment movement of the material hopper and remains at one and the same position also during an adjustment of the material hopper. In other words, the approach guidance aid can either be arranged stationary on the road paver or feeder or be configured to follow an adjustment movement of the material hopper, in particular of the side walls. A connection, following the movement of the material hopper, of the approach guidance aid to the road paver or feeder provides the advantage that by the increase of the material hopper and laterally extending the side walls due to the following of the approach guidance aid, a greater approach zone can be provided for the transport vehicle, which exceeds the outer edge of the machine or the side walls of the material hopper with material hopper parts decreased at maximum or adjusted toward the center of the machine.

Generally, the fastening device could be configured in such a way that it directly, that is with direct contact, fastens the approach guidance aid to the road paver or feeder. However, it is preferred that the fastening device comprises at least one holding arm, in particular two holding arms. The holding arm or the holding arms, respectively, are configured in such a way that they keep the approach guidance aid at a distance from the road paver or feeder and fasten the approach guidance aid at a distance to the road paver or feeder predetermined by the length of the holding arm. Thus, the holding arms extend between the road paver or feeder and the approach guidance aid and fasten those to one another. The position of the approach guidance aid can be selected as desired via the course of the holding arms, in particular in the operating direction and in the vertical direction, independent of the other configuration of the machine frame or the material hopper. Further, a joint or the like can particularly preferably be integrated in the region of the holding arms to ensure the displacement ability of the approach guidance aid and in particular of the guidance plate from a guidance position to a avoiding position.

Generally, the at least one holding arm can be fastened at any position of the approach guidance aid. To further increase the stability of the approach guidance aid, it is however preferred if the holding arm is fastened to the support plate. The holding arm thus preferably connects the road paver or feeder to the support plate of the approach guidance aid which again is fastened to the guidance plate of the approach guidance aid. It is also possible to provide for example a securing joint on the holding arm which is configured in such a way that it moves the holding arm only on a force effect on the holding arm exceeding a threshold or moves the support plate from its initial position, for example by a pivoting movement via a pivoting axis. With such a securing joint, it can be prevented that a damage and/or destruction of the approach guidance aid or the fastening device thereof happens, for example upon a collision of the transport vehicle with the approach guidance aid or support plate and/or the holding arms. The securing joint is thus configured in such a way that it folds back the holding arms together with the approach guidance aid if excessive forces act on the approach guidance aid. The securing joint comprises, for example, a spring-loaded locking element and/or a locking device acting in a frictionally-engaging manner.

One embodiment of the present invention provides that the holding arm and the support plate are arranged on the same side of the guidance plate. Then, the holding arm is fastened on one side of the support plate and the guidance plate on the other opposite side of the support plate. In this way, sufficient support of the approach guidance aid can be effected by the support plate and the holding arm. However, an improvement is achieved if, according to a preferred embodiment, the holding arm and the support plate are arranged on opposite sides of the guidance plate and the guidance plate is fixed between the holding arm and the support plate. In particular, the guidance plate is clamped between the holding arm and the support plate and thus fixed. This can be effected for example with corresponding threaded connections and/or clamp connections. In a particularly preferred embodiment, support plates are arranged on both sides of the guidance plate, between which the guidance plate is fixed. Here, the holding arm is fastened to one of the two support plates on which the guidance plate rests. Opposite this support plate on the other side of the guidance plate, a further support plate is located, which is fastened to the holding arm and the first support plate with the fastening means penetrating the guidance plate. The guidance plate is thus fixed between two support plates in some sort of sandwich structure, wherein both support plates are fixed to the holding arm, in particular via the same fastening means. In particular elastic guidance plates can be reliably mounted on the holding arms or on the road paver or feeder.

In a preferred embodiment, the hopper bottom of the material hopper of the road paver or feeder is configured to be pivotable about a rotational axis extending transverse to the operating direction, to enable a complete emptying in the working process. The hopper bottom can be pivoted in such a way that the side of the material hopper located in the front in the operating direction is moved or pivoted vertically upward and backward in the operating direction. Now, in analogy to the lateral adjustability of the material hopper transverse to the operating direction, it is possible to either fasten the approach guidance aid stationary on the road paver or feeder relative to this pivoting of the hopper bottom or, preferably, to configure the approach guidance aid following the movement of the hopper bottom. In the preferred variant, the approach guidance aid is pivoted together with the hopper bottom about the rotational axis extending transversely to the operating direction. Thus, the approach guidance aid is moved vertically upward, inter alia, wherein this movement is clearly discernable for the driver of the transport vehicle due to the extension of the course of the hopper bottom to the front in the operating direction through the approach guidance aid. The driver of the transport vehicle sees at first sight whether the material hopper or the hopper bottom of material hopper is pivoted about the rotational axis extending transversely to the operating direction, or not. Therefore, he or she can wait with the loading procedure until the hopper bottom is brought to the substantially horizontal position, in which loading usually is effected. In the configuration following the hopper bottom of material hopper, the approach guidance aid at the same time serves as an indication, in which position the hopper is in overall. This also increases safety and precision of the loading procedure.

Basically, the approach guidance aid could be located substantially only in front of the material hopper in the operating direction. This refers in particular to the guidance plate and less to the fastening device which can, for example, be arranged vertically below or above the material hopper or the machine frame. However, it is preferred if the approach guidance aid, and in particular the guidance plate, in each case is arranged at least partially vertically above, in front in the operating direction and vertically below the material hopper and/or the machine frame. The approach guidance aid thus encompasses the end of the material hopper and/or the machine frame located in front in the operating direction at least partially from in front in the operating direction to vertically downward. In other words, the approach guidance aid comprises a recess which receives the end of the material hopper and/or the machine frame located in front in the operating direction. In particular, it is preferred that the approach guidance aid comprises a recess in which an end of the hopper bottom located in the front in the operating direction is arranged so that the approach guidance aid is either arranged vertically below the hopper bottom and in front of the hopper bottom in the operating direction, wherein the approach guidance aid extends in front of the hopper bottom in the operating direction vertically upward beyond the hopper bottom. In this way, a particularly great planar dimension of the approach guidance aid can be achieved, which ensures an improved visibility of the approach guidance aid for the driver of the transport vehicle.

To further improve the visibility of the approach guidance aid for the driver of the transport vehicle, in particular in bad weather conditions or lighting conditions, it is preferred that the approach guidance aid comprises a visual marking arranged in the front in the operating direction. The visual marking according to the invention preferably includes elements designed in an optically noticeable manner such as light sources, in particular LEDs, and/or reflectors. Furthermore, the visual marking can be configured in one or multiple, in particular high-contrast, signal colors. By arranging the visual marking in the front in the operating direction, the position and/or alignment of the approach guidance aid is made clear to the driver of the transport vehicle, so that he has a reference point on which he can orient himself when approaching the road paver or feeder. Due to the noticeable design of the visual marking, it can be reliably seen even under difficult conditions.

Generally, it is sufficient if the visual marking is arranged at a well visible point on the approach guidance aid. For example, the visual marking can be arranged in the front in the operating direction and vertically up on the approach guidance aid. At this position, a good visibility is ensured. Specifically, when approaching to the road paver or feeder, the driver of the transport vehicle, however, often needs take a view through the rear mirror for positioning his vehicle. Depending on the approach angle, it can then be difficult to see the visual marking through the rear mirror of the transport vehicle. Therefore, it is preferred if the visual marking is arranged not only at one point on the approach guidance aid. Thus, for example multiple visual markings can be arranged in the front in the operating direction distributed over the vertical extension of the approach guidance aid. Particularly preferably, however, the visual marking is configured to cover the entire front side of the approach guidance aid in the operating direction. In this way, the vertical extension of the visual marking substantially corresponds to that of the approach guidance aid on its end located in the front in the operating direction. Even with difficult approach angles and on sight through the rear mirror, the visual marking therefore is well visible for the driver of the transport vehicle.

Usually, the approach guidance aid is in its guidance position during working mode of the road paver or feeder. The guidance position is the position of the approach guidance aid in which it projects from the remaining road paver/feeder in the front in the operating direction. The approach guidance aid is in particular always in the guidance position when the approach guidance aid is in its normal position and then, for example, does not collide with a transport vehicle. Collisions between the transport vehicle and the approach guidance aid always occur when the driver of the transport vehicle tightly misses the approach zone. Generally, a collision is of course to be avoided. However, if it still takes place during working operation of the road paver or feeder that the transport vehicle hits the approach guidance aid, the driver of the transport vehicle can hardly recognize that as he might not be able, for example, in this position to see the approach guidance aid. In a preferred embodiment of the invention, it is thus provided that such a collision is detected in another manner. To that end, it is preferably provided that a sensor device is arranged on the approach guidance aid which is configured in such a way that it produces a signal and transmits it to a control device if the approach guidance aid is moved from its guidance position, in particular beyond a determined threshold, to an avoiding position or an avoidance region. The sensor device can, for example, be a pressure of movement sensor via which device a movement of the approach guidance aid from the guidance position can be detected. For example, it can be a contact sensor which is actuated by the approach guidance aid being in the guidance position and in particular the guidance plate. If a collision of the transport vehicle with the approach guidance aid is detected by the sensor device, it transmits a signal to the control device which, for example, can be configured integrated in the on-board computer of the road paver or feeder. The control device receives the signal and displays it and/or transmits it to an additional display device. The display of the signal via the control device and/or the display device can displayed to the driver of the of the road paver or feeder and/or to the driver of the transport vehicle. For example, the control device can display the collision for the driver of the of the road paver or feeder via a display. Then again, the control device can also transmit the signal to a display device in the transport vehicle, for example via a wireless data connection, so that the collision of the vehicle with the approach guidance aid can be displayed to the driver of the transport vehicle. In this way, the driver of the transport vehicle is informed about a collision with the approach guidance aid otherwise invisible and he can reposition or correct the position of the transport vehicle correspondingly. Also, the output of acoustic and/or optical displays is possible.

Generally, the invention can be performed with an approach guidance aid which is arranged on one side of the road paver or feeder. However, particularly practical is one embodiment in which two approach guidance aids are present which are arranged spaced apart to one another in the operating direction. The approach guidance aids are in particular configured identically and/or mirrored toward the center of the machine. In particular, the two approach guidance aids enclose the approach zone for the transport vehicle seen transverse to the operating direction. In this way, the approach zone is indicated on both sides by an approach guidance aid, whereby the driver of the transport vehicle can approach the road paver or feeder particularly precisely for the transfer procedure. Both approach guidance aids further are arranged between the inner walls of the side walls of the hopper.

The object mentioned above is further achieved with an approach guidance aid for a road paver or feeder, as described above. To avoid repetitions, reference is made to the above-mentioned descriptions. All features and advantages of the above described approach guidance aid of the road paver or feeder also apply to the approach guidance aid per se in the figurative sense.

BRIEF DESCRIPTION OF THE DRAWINGS

Hereinafter, the invention is described in detail using the exemplary embodiments shown in the figures. In the schematic figures:

FIG. 6 is a plan view on the starting region of the hopper of a road paver or feeder;

FIG. 7A shows a detail of a return device having a spiral groove; and

FIG. 7B shows a detail of a return device having a pressure spring.

DETAILED DESCRIPTION

Figure 1:
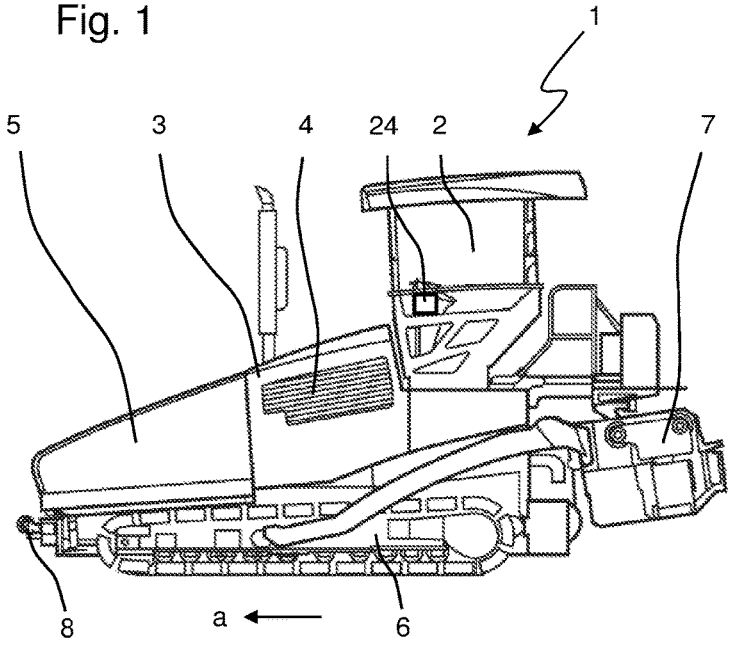
FIG. 1 is a side view of a road paver.

The same or similar components are denoted with the same reference numerals throughout the figures. Repeating components are not necessarily denoted separately in each figure.

Figure 2:
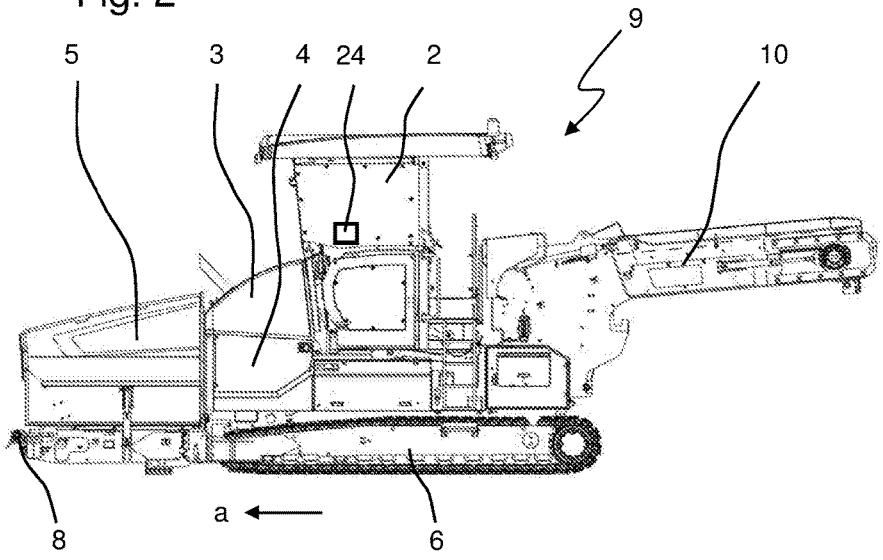
FIG. 2 is a side view of a feeder.

FIGS. 1 and 2 show generic road construction machines, specifically a road paver 1 (FIG. 1) and a feeder 9 (FIG. 2). The road construction machines 1, 9 comprise an operator platform 2 and a machine frame 3. Furthermore, they comprise a travel carriage 6 driven by a drive unit 4, which usually comprises a diesel combustion engine, with which travel carriage the road construction machines 1, 9 move ahead in the operating direction a during working operation. The road paver 1 comprises a paving screed 7 on its rear end with which it can distribute, even and compress paving material transversal to the operating direction a. In contrast, the feeder 9 does not comprise a screed 7 but a feeding conveyor 10 with which it can transfer paving material to a road paver 1. The road paver 1 as well as the feeder 9 comprise a material hopper 5 for paving material. The feeder 9 can transfer paving material from its material hopper 5 to the material hopper 5 of the road paver 1 via the feeding conveyor 10. Furthermore, the road paver 1 as well as the feeder 9 can be supplied with paving material from a transport vehicle, which is not shown, for example a truck. The road construction machines 1, 9 comprise buffer rollers 8 arranged in the front in the operating direction a for this kind of loading. With these buffer rollers 8, they push a transport vehicle in front of them during the loading process while paving material is transferred from the transport vehicle into the material hopper 5. While paving a base layer by the road paver 1, a plurality of loadings of paving material have to be transferred from transport vehicles to the road paver 1 and/or the feeder 9.

Figure 3:
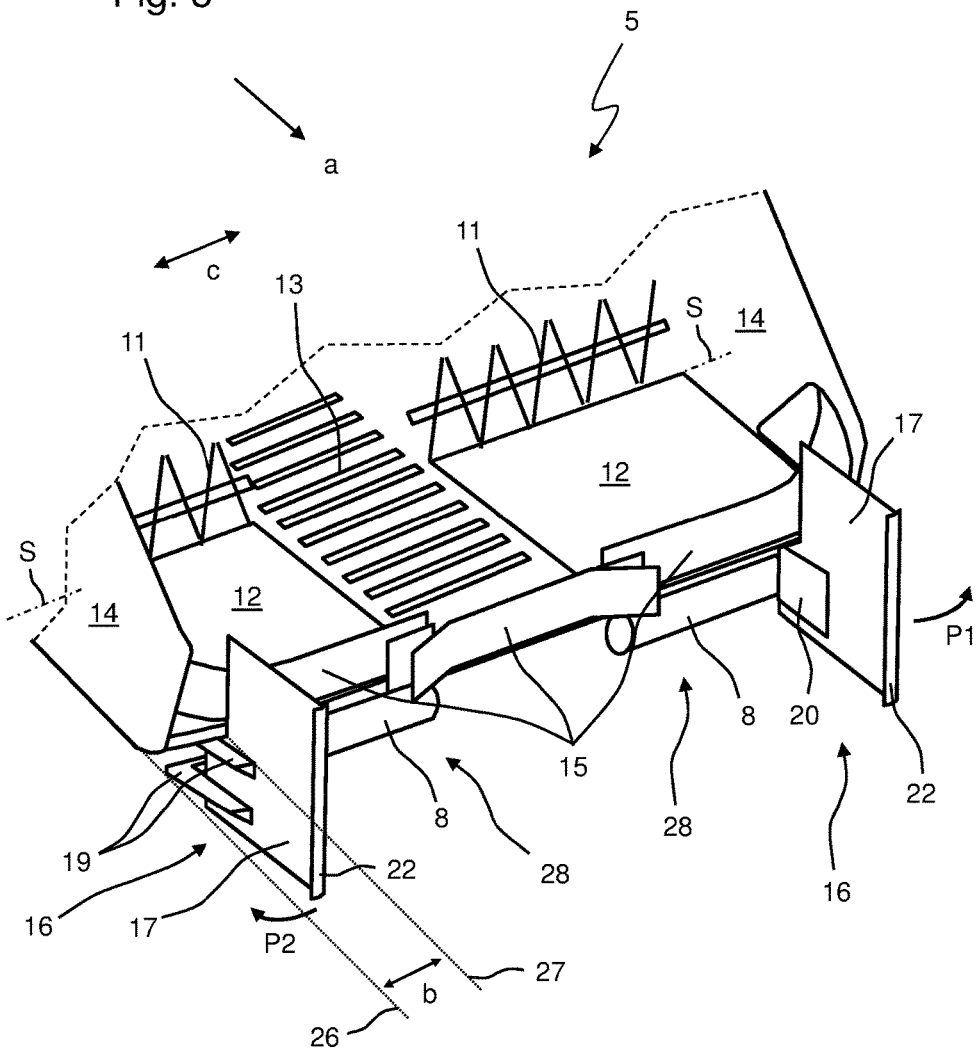
FIG. 3 is a perspective view of a material hopper seen from the front and obliquely from above.

FIG. 3 shows a perspective view obliquely from above and in the front in the operating direction a on the material hopper 5 of the road construction machines 1, 9. The material hopper 5 comprises a hopper bottom 12 and side walls 14. The side walls 14 of the material hopper 5 can be pivoted during the working operation to enable a loading of the hopper and/or to influence the size of the loading platform. On the side of the material hopper 5 located in the back in the operating direction a, a conveyor screw 11 is located which transfers paving material from the material hopper 5 onto a scraper belt 13 from which the paving material is transported opposite to the operating direction a through the road construction machine 1, 9 and is brought either to a screed 7 or a feeding conveyor 10. On the side of the material hopper 5 in the front in the operating direction a, an elastic retaining element 15 is located which prevents paving material from falling out of the material hopper 5 towards the operating direction a. The side of the material hopper 5 arranged in the front in the working or paving direction a is also referred to as filling side or docking side. At the filling side or docking side of the material hopper 5, buffer rollers 8 are located which are assigned to the collision device 28. Furthermore, at this place, two approach guidance aids 16 spaced apart from one another transversal to the operating direction a, which project over the material hopper 5 in the operating direction a. The two approach guidance aids 16 arranged between the inner walls of the side walls 14 are located next to the collision device 28 transversal to the operating direction a and enclose this device, and therefore also the approach zone for the transport vehicle. Here, the two approach guidance aids 16 are in the guidance position and project in the paving direction a with a distance A at maximum in the horizontal plane from the material hopper 5 and in particular also from the buffer rollers 8. Both approach guidance aids 16 can be adjusted from the guidance position shown in FIG. 3 in each case outward and thus away from the material hopper 5 or the approach zone to a turn-out position or a turn-out region in horizontal direction in case of a collision, as illustrated in Fig. by the arrows P1 (for the left approach guidance aid 16) and P2 (for the right approach guidance aid 16).

Figure 4:
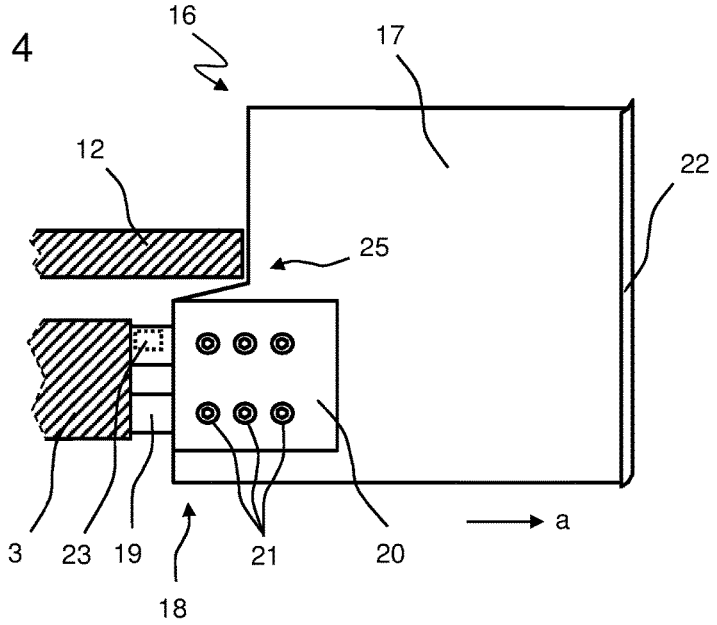
FIG. 4 is a side view of an approach guidance aid.
Figure 5:
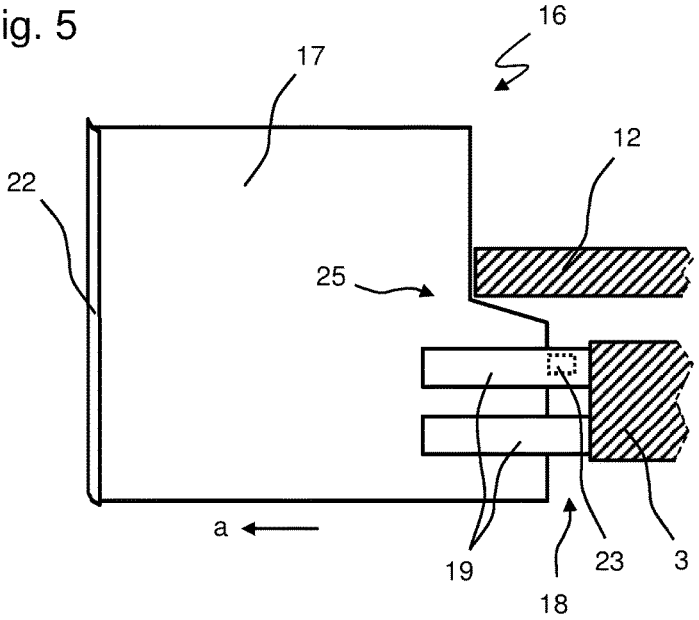
FIG. 5 is a side view of the other side of the approach guidance aid according to FIG. 4.

The two approach guidance aids 16 are configured identically. FIGS. 4 and 5 show one of the two approach guidance aids 16 in each case in side view, in FIG. 4 outward transversal to the operating direction and in FIG. 5 seen toward the center of the machine transversal to the operating direction. The approach guidance aid 16 includes an elastic guidance plate 17 and is fastened to the machine frame 3 of the road paver 1 or of the feeder 9 via the fastening device 18. In the exemplary embodiment shown, the fastening device 18 includes two holding arms 19 which for their part are fastened to the machine frame 3 of the road paver 1 or feeder 9. Furthermore, the holding arms 19 are fastened to the support plate 20 of the approach guidance aid with fastening means 21 (FIG. 4). The fastening means 21 completely penetrate the guidance plate 17 from the holding arms 19 to the support plate 20 and the support plate 20 as well. The fastening means 21 are mostly threaded bolts onto which nuts are screwed with washers on the side of the support plate 20. The guidance plate 17 is fixed between the holding arms 19 and the support plate 20. The holding arms 19 thus rest on one side of the guidance plate 17 while the support plate 20 rests on the opposite side of the guidance plate 17 against said plate. The support plate 20 is made of a solid, inflexible material and thereby supports the guidance plate 17 in such a way that the guidance plate 17 is held in its position. The approach guidance aid 16, and in particular the guidance plate 17 and the support plate 20 are aligned vertically and in the operating direction a. In other words, the greatest extension of the approach guidance aid 16 is in a vertical plane which is oriented in the operating direction a.

As can be seen from FIGS. 4 and 5, the approach guidance aid 16, in particular the guidance plate 17, is arranged both in front of the hopper bottom 12 and the machine frame 3 in the operating direction a, and also at least partially vertically under the hopper bottom 12. In other words, the approach guidance aid 16 engages around the hopper bottom 12 from the front in the operating direction a to vertically downward. Overall, the approach guidance aid 16 thus extends vertically downward in front of the hopper bottom 12 and the machine frame 3 in the operating direction a and upward beyond the hopper bottom 12 while it extends into a region vertically under the hopper bottom. To enable this form of the approach guidance aid 16, it comprises, in particular the guidance plate 17, a corner recess 25 which is adapted to the course of the hopper bottom 12 and of the machine frame 3. In particular, the approach guidance aid 16 is arranged on the road paver 1 or feeder 9 in such a way that the hopper bottom 12 is located in the corner recess 25 or is received by the corner recess 25. This configuration enables a particularly great dimension of the approach guidance aid 16 which therefore can be seen particularly well by the driver of the transport vehicle.

On the side or edge of the approach guidance aid 16 located in front in the operating direction a, a visual marking 22 is located which extends over the entire side of the approach guidance aid 16 or the guidance plate 17 located in front in the operating direction a in the vertical direction. The visual marking 22 is configured striped, with alternating signal colors, for example red and white, so that it visually impacts the driver of the transport vehicle. The visual marking 22 is the component of the road paver 1 or feeder 9 projecting farthest to the front in the operating direction a and thus has a central role in approaching the transport vehicle to the filling or docking side of the material hopper 5. For this reason, a particularly good visibility is ensured by the signal colors.

As can be seen in FIG. 3, the two approach guidance aids 16 enclose the collision device 28 with the buffer rollers 8 thereof and thus the approach zone for the transport vehicle. However, the approach guidance aids 16 are not arranged as an extension of the outer edge of the machine 26 which is predetermined by the side walls 14 of the material hopper 5, for example. In contrast, the approach guidance aids 16 are arranged offset with respect to the outer edge of the machine 26 and also to the side walls 14 of the material hopper 5 to the center of the machine by the distance b. The distance b therefore denotes the distance between an outer edge of the machine 26 in operating direction a or of an imaginary extension of the outer edge of the machine 26 in the operating direction a and the guidance aid position 27 also extended to the front in the operating direction a in which position the approach guidance aid 16 is mounted on the road paver 1 or feeder 9. In FIG. 3, various adjustment movements on the material hopper 5 or on elements thereof are indicated as well. Thus, the hopper bottom 12 and the side walls 14 can, for example, be adjusted in the adjustment direction c transversal to the operating direction a. The components of the material hopper 5 arranged on the left and on the right when seen from the center of the machine can be moved toward one another to reduce the overall volume of the material hopper 5. In contrast, the side walls 14 and the hopper bottom 12 can be moved away from the center of the machine in the adjustment direction c, so that the overall volume of the material hopper 5 is increased. Additionally, the hopper bottom 12 can be pivoted about a pivot axis S in such a way that the parts of the hopper bottom located in the front in the operating direction a are lifted vertically upward. Paving material located on the hopper bottom 12 is thereby poured, respectively dumped into the conveyor screw 11 and transported onto the scraper belt 13. In order to indicate the respective positions of the material hopper 5 to the driver of the transport vehicle, it is possible to fasten the approach guidance aids 16, for example on the hopper bottom 12, in such a way that they follow the respective movement of the hopper bottom 12 as an adjustment movement in the adjustment direction c or as a pivoting movement about the pivot axis S. In this way, it is clear with one look on the approach guidance aid 16 in which position the material hopper 5 is in. Usually, the transferring procedure takes place when the material hopper 5 is extended at maximum transversal to the operating direction a in the adjustment direction c and the hopper bottom 12 is in the horizontal position. If said position is displayed by the approach guidance aids 16, the driver of the transport vehicle can start the transfer procedure. In the shown exemplary embodiment of FIGS. 4 and 5, however, the approach guidance aid 16 is fastened on the machine frame 3 and is thus stationary relative to the machine frame 3, so that, for example, the hopper bottom 12 and the other parts of the material hopper 5 can move independently of the approach guidance aids 16. The approach guidance aids 16 are thus always arranged at the same place and, independent of the position of the material hopper 5, ensure a reliable positioning of the transport vehicle in front of the material hopper 5 in the approach zone.

FIGS. 4 and 5 indicate a sensor device 23 which detects if the approach guidance aid 16 is moved from its guidance position to a turn-out position laterally outward and away from the material hopper. This takes place each time a transport vehicle collides with the approach guidance aid 16. Due to the forces acting on the approach guidance aid and/or the change of position from the guidance position, the sensor device detects a collision and notifies the control device (see FIGS. 1 and 2). The control device 24 in turn processes the signal of the sensor device 23 and displays this either to the driver of the road paver 1 or feeder 9 and to the driver of the transport vehicle. The signal is transmitted by the control device 24 to a receiver or a display device in the transport vehicle via a wireless data connection for the display for the driver of the transport vehicle. In this way, the driver of the transport vehicle is notified about the collision with the approach guidance aid 16 and can reposition the transport vehicle correspondingly.

FIG. 6 further illustrates a basic idea of the invention. It can be seen from the significantly simplified plan view of FIG. 6 on the hopper region of the road paver or feeder of FIGS. 1 and 2 located in the front in the paving direction a, that the approach guidance aids 16 in the guidance position (solid lines) project from the material hopper 5 at maximum in the horizontal direction in the direction of the paving direction A. The approach zone for a transport vehicle is located between the two approach guidance aids. From the guidance position, the approach guidance aids 16, in particular the guidance plate 17 thereof, can be adjusted outwardly, i.e. away from the approach zone when colliding with a transport vehicle. For the variant on the left in FIG. 6, the guidance plate 17 pivots about a vertical pivot axis R to a turn-out position (dotted line) of a turn-out region which can, for example be greater than 60° based on the guidance position. To that end, the guidance plate is hinged on the remaining vehicle via a pivot joint 29 within the holding arm 19 (not shown). Here, the guidance plate 17 can thus per se be made of a rigid, bend-proof material. Alternatively thereto, it is provided for the variant on the right in FIG. 6 that it is bent from the guidance position to the turn-out position (dotted illustrated) in case of a collision. To that end, the guidance plate 17 here is at least partially made of an elastic material, for example a rubber material.

It is provided for both variants that these automatically return to their guidance position as soon as the collision is eliminated and thus the force effect caused thereby on the guidance plates 17 is omitted. For the right variant, this takes place simply due to the return tension built up in the elastic material. For the left variant, however, an additional return device 30 is provided the function of which is to move the guidance plate 17 from the turn-out position back to the guidance position. Examples for essential elements of such a return device 30 are illustrated in more detail in FIGS. 7A and 7B.

FIG. 7A shows a detail of a machine-side spiral groove 32, for example as an axle part of the pivot joint 29, with a spiral axis extending in the vertical direction. The guidance plate 17 (only indicated) extends in the spiral groove 32 with its joint part. Here, the joint 29 is configured in such a way that the guidance plate 17 in the guidance position thereof assumes the lowest point thereof in the vertical direction in the spiral groove 32. If the guidance plate 17 is pushed from the guidance position to a turn-out position, it is at the same time offset in the vertical direction along the spiral groove 32 upward and thereby gains potential energy which subsequently can be used for returning purposes.

According to FIG. 7B, the return device 30 can for example also include a tension spring 33 (or even a pressure spring) which can be arranged in such a way, for example between a guidance plate 17 and a further part, for example a holding arm 19 or another part stationary with respect to the hopper walls or the machine frame.

FIG. 6 further illustrates a back-pivot stop 31 for the guidance plate 17. The stop represents a pivoting limit for the guidance plate 17 and prevents in particular that the guidance plate 17 pivots beyond the guidance position from a turn-out position located outside relative to the material hopper.

Overall, a precise aid for positioning the transport vehicle in the approach zone of the road paver or feeder is provided by the approach guidance aid 16 according to the invention and the described embodiments thereof, whereby the workflow in loading the road paver 1 or feeder 9 is facilitated and at the same time damage or destruction of the side walls 14 of the material hopper 5 is reliably prevented.

What is claimed is:

1. A road paver or feeder, comprising:

a machine frame, a travel carriage driven by a drive unit, and a material hopper arranged in a front on the road paver or feeder in an operating direction, which comprises a hopper bottom and side walls extending in the operating direction, wherein at least one approach guidance aid projects beyond the hopper bottom in the operating direction and the side walls in the operating direction in a guidance position opposite a paving direction is arranged on the road paver or feeder in an edge region of the material hopper located outside transversely to the operating direction, the approach guidance aid being adjustable at least partially outward from the guidance position to an avoiding position in a non-destructive manner.

2. The road paver or feeder according to claim 1, wherein the approach guidance aid includes an elastic guidance plate which projects beyond the side walls in the operating direction and which is pivotable about a vertical axis via a pivot joint.

3. The road paver or feeder according to claim 2, wherein in the guidance position, the guidance plate projects horizontally in the operating direction to a maximum extent.

4. The road paver or feeder according to claim 1, further comprising a return device, which autonomously returns the approach guidance aid from the avoiding position to the guidance position.

5. The road paver or feeder according to claim 4, wherein the return device comprises at least one of the following features:

the return device is configured such that the autonomous return results from an effect of an elastic material of the approach guidance aid;

the return device includes a spring load of a tension spring or a pressure spring;

the return device is driven by gravity, including a spiral groove guidance;

the return device includes a releasable latch device with which the approach guidance aid is held in the guidance position up to a predetermined load limit.

6. The road paver or feeder according to claim 1, wherein the approach guidance aid is oriented parallel to the operating direction and vertical.

7. The road paver or feeder according to claim 1, wherein the approach guidance aid is arranged transversely to the operating direction offset inwardly from an outer edge of the side wall.

8. The road paver or feeder according to claim 1, further comprising a collision device with at least one buffer roller, with which a transport vehicle ahead of the road paver or feeder in the operating direction is pushable in a loading process, and the approach guidance aid is arranged offset outward from the collision device transversely to the operating direction.

9. The road paver or feeder according to claim 1, wherein the approach guidance aid includes a support plate, which is arranged parallel to a guidance plate of the approach guidance aid, and rests against the guidance plate and is fastened thereto.

10. The road paver or feeder according to claim 1, wherein the approach guidance aid comprises a fastening device, via which the approach guidance aid is fastened to the machine frame and to the material hopper.

11. The road paver or feeder according to claim 10, wherein the fastening device comprises at least one holding arm.

12. The road paver or feeder according to claim 11, wherein the holding arm is fastened to a support plate, which is arranged parallel to a guidance plate of the approach guidance aid, and rests against the guidance plate and is fastened thereto.

13. The road paver or feeder according to claim 12, wherein the holding arm and the support plate are arranged on opposite sides of the guidance plate and the guidance plate is fixed between the holding arm and the support plate.

14. The road paver or feeder according to claim 1, wherein the hopper bottom of the material hopper is configured to be pivotable about a rotational axis extending transversely to the operating direction and the approach guidance aid is configured to follow movement of the hopper bottom.

15. The road paver or feeder according to claim 1, wherein the approach guidance aid comprises a corner recess, in which an end of the hopper bottom is arranged, such that the approach guidance aid is arranged both vertically under the hopper bottom and in front of the hopper bottom in the operating direction, the approach guidance aid extending vertically upward beyond the hopper bottom in front of the hopper bottom in the operating direction.

16. The road paver or feeder according to claim 1, wherein the approach guidance aid comprises a visual marking arranged in a front of the approach guidance aid in the operating direction.

17. The road paver or feeder according to claim 16, wherein the visual marking covers an entire front side of the approach guidance aid in the operating direction.

18. The road paver or feeder according to claim 1, wherein a sensor device is arranged on the approach guidance aid, which is configured to generate a signal and transmit the signal to a control device when the approach guidance aid is moved from the guidance position to the avoiding position.

19. The road paver or feeder according to claim 1, wherein the at least one approach guidance aid comprises two approach guidance aids, which are arranged spaced apart to one another transversely to the operating direction.

20. An approach guidance aid of a road paver or feeder according to claim 1.

* * * * *